US010413040B2

(12) United States Patent
Jeong et al.

(10) Patent No.: US 10,413,040 B2
(45) Date of Patent: Sep. 17, 2019

(54) FINGER INSERTION MASCARA CONTAINER COMPRISING WIPER HAVING CORRUGATED TUBE FORMED THEREON

(71) Applicant: AMOREPACIFIC CORPORATION, Seoul (KR)

(72) Inventors: Hae Won Jeong, Seoul (KR); Hyun Woo Roh, Seoul (KR); Eun Sil Han, Seoul (KR)

(73) Assignee: AMOREPACIFIC CORPORATION, Seoul (KR)

( * ) Notice: Subject to any disclaimer, the term of this patent is extended or adjusted under 35 U.S.C. 154(b) by 20 days.

(21) Appl. No.: 15/739,470

(22) PCT Filed: Jun. 30, 2016

(86) PCT No.: PCT/KR2016/007041
§ 371 (c)(1),
(2) Date: Dec. 22, 2017

(87) PCT Pub. No.: WO2017/007173
PCT Pub. Date: Jan. 12, 2017

(65) Prior Publication Data

US 2018/0184785 A1 Jul. 5, 2018

(30) Foreign Application Priority Data

Jul. 6, 2015 (KR) ..... 10-2015-0096127

(51) Int. Cl.
*A45D 34/04* (2006.01)
*A45D 40/26* (2006.01)
(Continued)

(52) U.S. Cl.
CPC ..... *A45D 34/046* (2013.01); *A45D 34/04* (2013.01); *A45D 34/043* (2013.01); *A45D 40/26* (2013.01);
(Continued)

(58) Field of Classification Search
CPC .... A45D 34/046; A45D 34/04; A45D 34/043; A45D 40/26; A45D 40/264;
(Continued)

(56) References Cited

U.S. PATENT DOCUMENTS 5,899,622 A * 5/1999 Gueret ..... A45D 34/045 401/122
6,505,631 B2 * 1/2003 Fischer ..... A45D 40/0087 132/218
(Continued)

FOREIGN PATENT DOCUMENTS

JP 2005-111959 A 4/2005
KR 10-0649052 B1 11/2006
(Continued)

*Primary Examiner* — David J Walczak
(74) *Attorney, Agent, or Firm* — Heedong Chae; Lucem, PC

(57) ABSTRACT

A finger insertion mascara container including a wiper having a corrugated tube formed thereon, the finger insertion mascara container being structured such that a packing is coupled to a container body, which contains mascara liquid. a wiper, which has a corrugated tube formed thereon using an elastic material, is coupled to the lower side of the packing; a finger insertion member is coupled to the inside of the wiper, which has the corrugated tube formed thereon, the finger insertion member having a finger insertion space formed therein and having a finger retaining portion formed to extend upwards; and a brush rod, which has a mascara brush, is coupled to the lower side of the finger insertion member.

9 Claims, 11 Drawing Sheets

(51) Int. Cl.

| | |
|---|---|
| ***B65D 25/02*** | (2006.01) |
| ***B65D 41/04*** | (2006.01) |
| ***B65D 51/32*** | (2006.01) |
| ***B65D 53/02*** | (2006.01) |
| ***A46B 9/02*** | (2006.01) |
| *A45D 34/00* | (2006.01) |

(52) U.S. Cl.
CPC ..... *A45D 40/264* (2013.01); *A45D 40/267* (2013.01); *A46B 9/021* (2013.01); *B65D 25/02* (2013.01); *B65D 41/04* (2013.01); *B65D 51/32* (2013.01); *B65D 53/02* (2013.01); *A45D 2034/007* (2013.01)

(58) Field of Classification Search
CPC ..... A45D 40/267; A45D 2034/007; A45D 34/047; A45D 40/268; B65D 25/02; B65D 41/04; B65D 51/32; B65D 53/02; A46B 9/021
See application file for complete search history.

(56) References Cited

U.S. PATENT DOCUMENTS

| | | | | |
|---|---|---|---|---|
| 7,044,669 | B2 * | 5/2006 | Winckels ..... | A45D 34/046 401/122 |
| 7,186,044 | B2 * | 3/2007 | Bailly ..... | A45D 40/267 132/218 |

FOREIGN PATENT DOCUMENTS

| | | | |
|---|---|---|---|
| KR | 20-0446791 | Y1 | 12/2009 |
| KR | 20-0459829 | Y1 | 4/2012 |
| KR | 10-1305631 | B1 | 9/2013 |

* cited by examiner

-- Prior Art --

-- Prior Art --

-- Prior Art --

FINGER INSERTION MASCARA CONTAINER COMPRISING WIPER HAVING CORRUGATED TUBE FORMED THEREON

CROSS-REFERENCE TO RELATED APPLICATION

This application claims the benefit of Korean application No. 10-2015-0096127, filed on Jul. 6, 2015 with the Korean Intellectual Property Office, the disclosure of which is incorporated herein by reference.

TECHNICAL FIELD

The present invention relates to a finger insertion mascara container including a wiper having a corrugated tube, and more particularly, to a finger insertion mascara container including a wiper having a corrugated tube, in which a packing is coupled to a container body containing a mascara liquid therein, the wiper having the corrugated tube, which is formed of an elastic material, is coupled to a lower side of the packing, a finger insertion member formed therein with a finger insertion space and having a finger retaining portion which extends upwards is coupled to an inside of the wiper having the corrugated tube, and a brush rod having a mascara brush is coupled to a lower side of the finger insertion member. When a user inserts a finger into the finger insertion space to use the mascara liquid during eyelash makeup, if the mascara liquid remains only on a lower portion of the container body, the user presses the wiper having the corrugated tube downwards using the finger insertion member while the finger remains inserted into the finger insertion space, so that the wiper having the corrugated tube is elastically stretched to allow the brush to smear the mascara liquid remaining in the lower portion of the container body for use, thereby preventing the mascara liquid from remaining inside the container body.

BACKGROUND ART

Color cosmetics, which are used to beautifully adorn the skin of a user by making the appearance beautiful, are classified into a base makeup used for making a skin color uniform and covering a defect, and a point makeup used for partially enhancing a three-dimensional effect of a lip, eyes, or nails. The base makeup includes a makeup base, a foundation, and a powder, and the point makeup includes a lipstick, an eye liner, and mascara.

The mascara is a cosmetic product which allows eyelashes to look thick and long so that it can give a clear impression, and a brush is used to apply a cosmetic material on the eyelashes.

In general, the mascara includes a brush integrally formed on a lid of a container containing a mascara cosmetic material. When a user opens the lid to use the cosmetic material, the contents are put on the brush so that the contents put on the brush may be applied to eyelashes.

However, in the mascara container according to the related art, when the user desires to use a mascara liquid remaining in a regular mascara container by smearing the mascara liquid on a mascara brush, the user stirs with the mascara brush while putting the mascara brush in the container to smear the mascara liquid on the mascara brush. Since it is not easy to smear the mascara liquid by stirring the mascara brush within a narrow space, the remaining mascara cannot be used. In addition, users tend to discard the mascara even if there is remaining mascara in the mascara container, resulting in a waste of resources.

In order to solve the above problems, as shown in FIG. 1, the applicant has filed Korean Utility Model Registration No. 20-0418969 that discloses a deformable mascara container, in which an opening member is coupled to an upper portion of an inner container 1, which is formed of a soft material and contains a mascara liquid, and a deformable outer container 2 having a shape of a spring or bellows and capable of protecting the inner container 1 is coupled to the inner container 1 while surrounding an outer periphery of the inner container 1. Accordingly, when an amount of the mascara liquid remaining in the inner container 1 is small, the remaining mascara liquid present on a wall surface of the container can be easily smeared on the mascara brush for use by deforming the mascara container, so the mascara liquid may be prevented from remaining in the inner container 1.

However, in the above related art, the container is deformed to be folded to the left and right so that the mascara liquid present on the wall surface can be smeared on the mascara brush, whereas the mascara liquid remaining in a lower portion of the container cannot be used, so the mascara liquid may still remain.

In order to solve the above problems, as shown in FIG. 2, the applicant has disclosed Korean Utility Model Publication No. 20-2013-0007443, in which a grip body of a mascara container is formed of a flexible material, so that the mascara container can be squeezed and a mascara brush can reach an inner side wall of a container 3, so that the entire mascara liquid present in the container 3 can be used, thereby preventing the mascara liquid from remaining in the container 3.

However, in the above related art, when a volatile mascara liquid is stored in the flexible container 3 for a long period of time, volatile components of the mascara liquid are volatilized into air through fine pores of the flexible material, so that the mascara liquid is hardened and cannot be used.

In addition, since the user has to press the mascara brush with a hand to smear the mascara liquid on the mascara brush whenever the user uses the remaining mascara liquid, too much force is required when the user is a woman.

In order to solve the above problems, as shown in FIG. 3, there is disclosed Japanese Patent Publication No. 25135749, in which a container lid on which a packing is formed is coupled to an inner upper portion of a container body containing contents, an elastically deformable cap 4 is coupled to an upper portion of the container lid, a brush rod is coupled to an inner center of the cap 4, and an application member bent to one side is formed at a lower portion of the brush rod. Accordingly, the cap 4 is pressed to the left and right so as to scrape the remaining contents on a lower edge of the container body with the application member, which is bent to one side, and smear the remaining contents on the application member, so that the remaining contents can be used.

However, in the above related art, the cap 4 is pressed to the left and right while the container lid is closed so as to scrape the contents remaining in the lower portion of the container body, whereas it is not easy to accurately scrape the remaining contents in the container by pressing the container lid and stirring the application member, so the contents may still remain.

DISCLOSURE

Technical Problem

To solve the problems described above, an object of the present invention is to provide a finger insertion mascara container including a wiper having a corrugated tube, in which a packing is coupled to a container body containing a mascara liquid therein, the wiper having the corrugated tube, which is formed of an elastic material, is coupled to a lower side of the packing, a finger insertion member formed therein with a finger insertion space and having a finger retaining portion which extends upwards is coupled to an inside of the wiper having the corrugated tube, and a brush rod having a mascara brush is coupled to a lower side of the finger insertion member. When a user inserts a finger into the finger insertion space to use the mascara liquid during eyelash makeup, if the mascara liquid remains only on a lower portion of the container body, the user presses the wiper having the corrugated tube downwards using the finger insertion member while the finger remains inserted into the finger insertion space, so that the wiper having the corrugated tube is elastically stretched to allow the brush to smear the mascara liquid remaining in the lower portion of the container body for use, thereby preventing the mascara liquid from remaining inside the container body.

In addition, an object of the present invention is to provide a finger insertion mascara container including a wiper having a corrugated tube, in which a pressing protrusion wheel is formed at an inner upper portion of a container lid, and when the container lid is closed while the finger insertion member is placed inside the wiper having the corrugated tube, the pressing protrusion wheel presses an upper end of the finger retaining portion while the wiper having the corrugated tube is pushed to the lower portion of the container body to allow the corrugated tube to be stretched, so that the finger insertion member tightly seals the container body, thereby preventing the mascara liquid contained in the container body from being volatilized.

In addition, an object of the present invention is to provide a finger insertion mascara container including a wiper having a corrugated tube, in which a counter-flow preventing protrusion wheel is formed at a lower portion of the wiper having the corrugated tube, and when the finger insertion member is taken out, and the mascara liquid smeared on the brush rod is scraped from the wiper having the corrugated tube, the mascara liquid is prevented from rising on an outer peripheral surface of the wiper having the corrugated tube by the counter-flow preventing protrusion wheel, so that the mascara liquid may be prevented from entering and being solidified in a space between the wiper having the corrugated tube and a wall surface of the container body.

In addition, an object of the present invention is to provide a finger insertion mascara container including a wiper having a corrugated tube, in which the brush rod is formed to be bent in the direction of a lower edge of the container body, and the mascara liquid remaining in the lower edge of the container body and the mascara liquid smeared on the wall surface is scratched and collected by rotating the finger insertion member so that the remaining mascara liquid is smeared on the brush for use. Accordingly, all the mascara liquid present in the container body may be used, thereby preventing resources from being wasted.

Technical Solution

According to the present invention, a finger insertion mascara container including a wiper having a corrugated tube includes: a container body (10) containing a mascara liquid therein, and formed at an upper portion thereof with an opening (11); a wiper (30) installed in the opening (11) of the container body (10) to sweep the mascara liquid, and formed on an outer peripheral surface thereof with a corrugated tube (31); a finger insertion member (40) inserted into the wiper (30), formed therein with a finger insertion space (41), and formed at a lower side thereof with a coupling extension portion (43); and a brush rod (50) coupled to the coupling extension portion (43) of the finger insertion member (40), and formed at a lower side thereof with a brush (51), wherein the wiper (30) having the corrugated tube (31) is formed of an elastic material so as to be elastically stretched and returned.

In addition, the finger insertion mascara container including the wiper having the corrugated tube may further include a packing (20) coupled between the opening (11) of the container body (10) and the wiper (30).

In addition, the finger insertion mascara container including the wiper having the corrugated tube may further include a counter-flow preventing protrusion wheel (32) formed on a lower outer peripheral surface of the wiper (30) to prevent the mascara liquid from counter-flowing.

In addition, the finger insertion member (40) may be formed on an inner peripheral surface thereof with an anti-slip protrusion (42).

In addition, a finger retaining portion (44) may extend from an upper portion of the finger insertion member (40), and an elastic slit portion (45) may be formed in a middle of the finger retaining portion (44).

In addition, the finger insertion mascara container including the wiper having the corrugated tube may further include a container lid (60) coupled to the upper portion of the container body (10).

In addition, a pressing protrusion wheel (61) may be formed on an inner surface of the container lid (60).

Advantageous Effects

According to the finger insertion mascara container including the wiper having the corrugated tube of the present invention, a packing is coupled to a container body containing a mascara liquid therein, the wiper having the corrugated tube, which is formed of an elastic material, is coupled to a lower side of the packing, a finger insertion member formed therein with a finger insertion space and having a finger retaining portion which extends upwards is coupled to an inside of the wiper having the corrugated tube, and a brush rod having a mascara brush is coupled to a lower side of the finger insertion member. When a user inserts a finger into the finger insertion space to use the mascara liquid during eyelash makeup, if the mascara liquid remains only on a lower portion of the container body, the user presses the wiper having the corrugated tube downwards using the finger insertion member while the finger remains inserted into the finger insertion space, so that the wiper having the corrugated tube can be elastically stretched to allow the brush to smear the mascara liquid remaining in the lower portion of the container body for use, thereby preventing the mascara liquid from remaining inside the container body.

In addition, according to the finger insertion mascara container including the wiper having the corrugated tube of the present invention, a pressing protrusion wheel is formed at an inner upper portion of a container lid, and when the container lid is closed while the finger insertion member is placed inside the wiper having the corrugated tube, the pressing protrusion wheel presses an upper end of the finger retaining portion while the wiper having the corrugated tube is pushed to the lower portion of the container body to allow the corrugated tube to be stretched, so that the finger insertion member tightly seals the container body, thereby preventing the mascara liquid contained in the container body from being volatilized.

In addition, according to the finger insertion mascara container including the wiper having the corrugated tube of the present invention, a counter-flow preventing protrusion wheel is formed at a lower portion of the wiper having the corrugated tube, and when the finger insertion member is taken out, and the mascara liquid smeared on the brush rod is scraped from the wiper having the corrugated tube, the mascara liquid is prevented from rising on an outer peripheral surface of the wiper having the corrugated tube by the counter-flow preventing protrusion wheel, so that the mascara liquid can be prevented from entering and being solidified in a space between the wiper having the corrugated tube and a wall surface of the container body.

In addition, according to the finger insertion mascara container including the wiper having the corrugated tube of the present invention, the brush rod is formed to be bent in the direction of a lower edge of the container body, and the mascara liquid remaining in the lower edge of the container body and the mascara liquid smeared on the wall surface is scratched and collected by rotating the finger insertion member so that the remaining mascara liquid is smeared on the brush for use. Accordingly, all the mascara liquid present in the container body can be used, thereby preventing resources from being wasted.

BEST MODE

Mode for Invention

Hereinafter, a finger insertion mascara container including a wiper having a corrugated tube according to an embodiment of the present invention will be described with reference to accompanying drawings.

Figure 1:
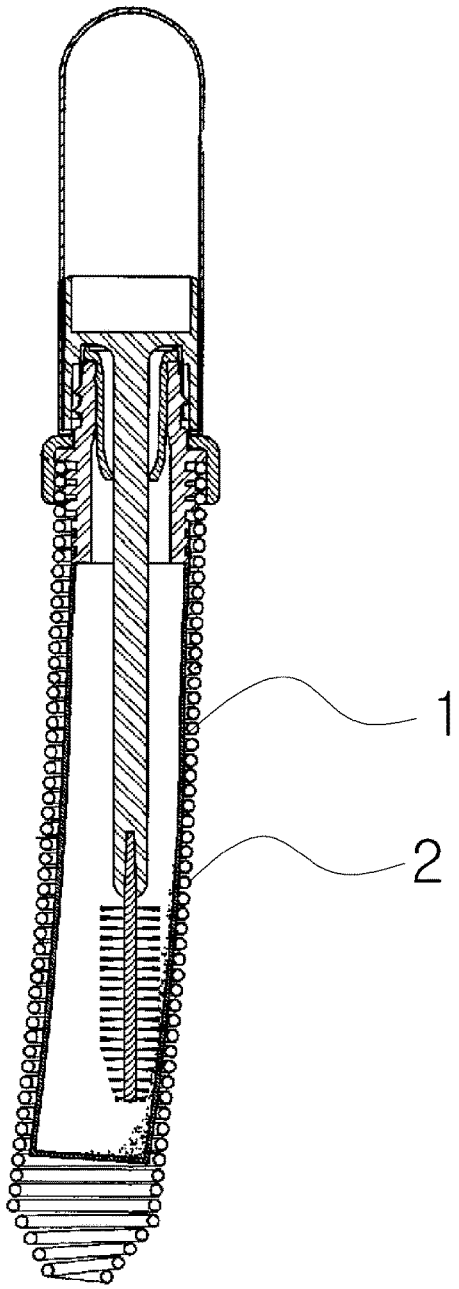
FIG. 1 is a sectional view showing a mascara container according to a related art.
Figure 2:
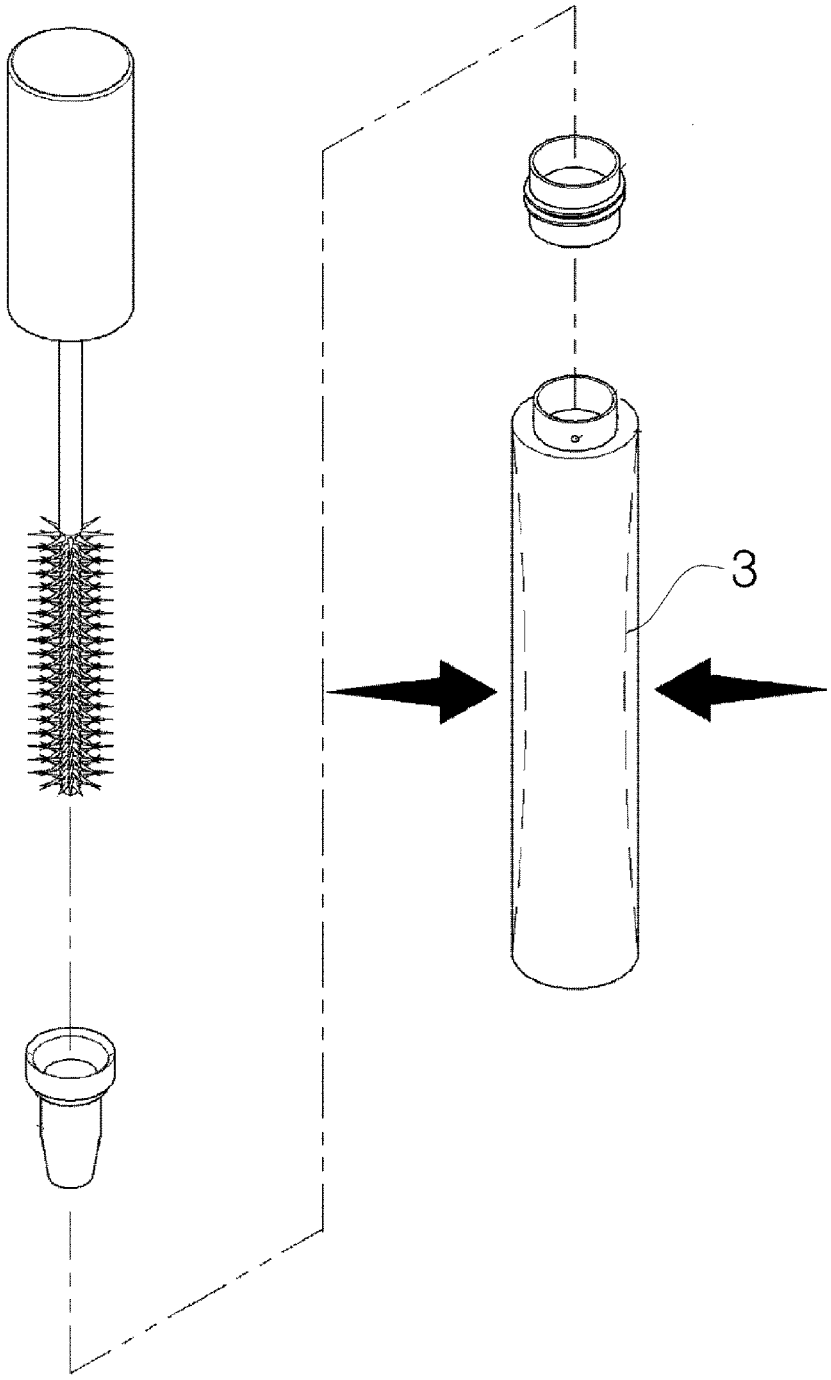
FIG. 2 is an exploded perspective view showing a mascara container according to another related art.
Figure 3:
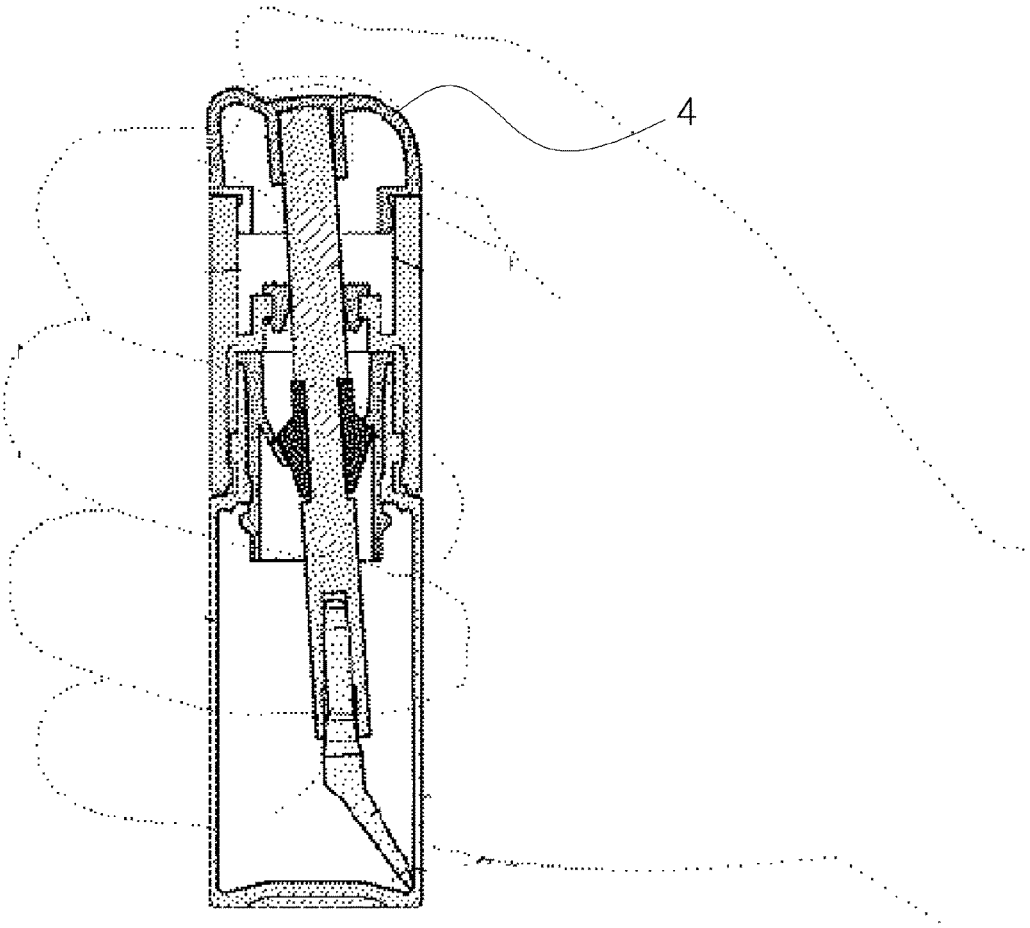
FIG. 3 is a sectional view showing a mascara container according to still another related art.
Figure 4:
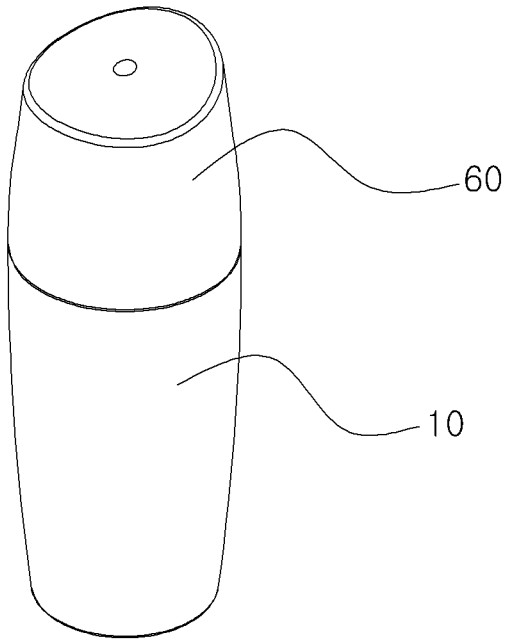
FIG. 4 is a perspective view showing a finger insertion mascara container including a wiper having a corrugated tube according to an embodiment of the present invention.
Figure 5:
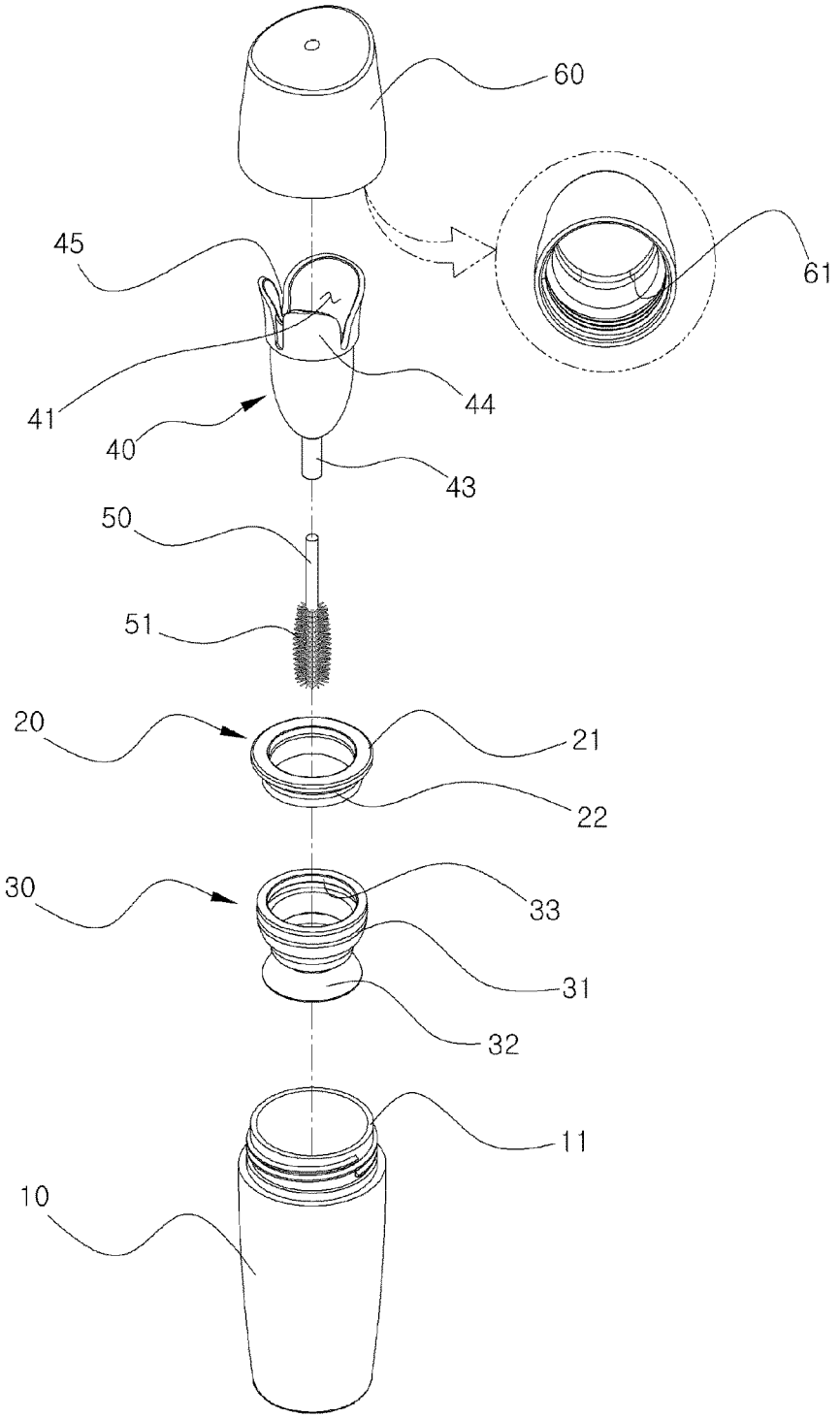
FIG. 5 is an exploded perspective view showing the finger insertion mascara container including the wiper having the corrugated tube according to an embodiment of the present invention.
Figure 6:
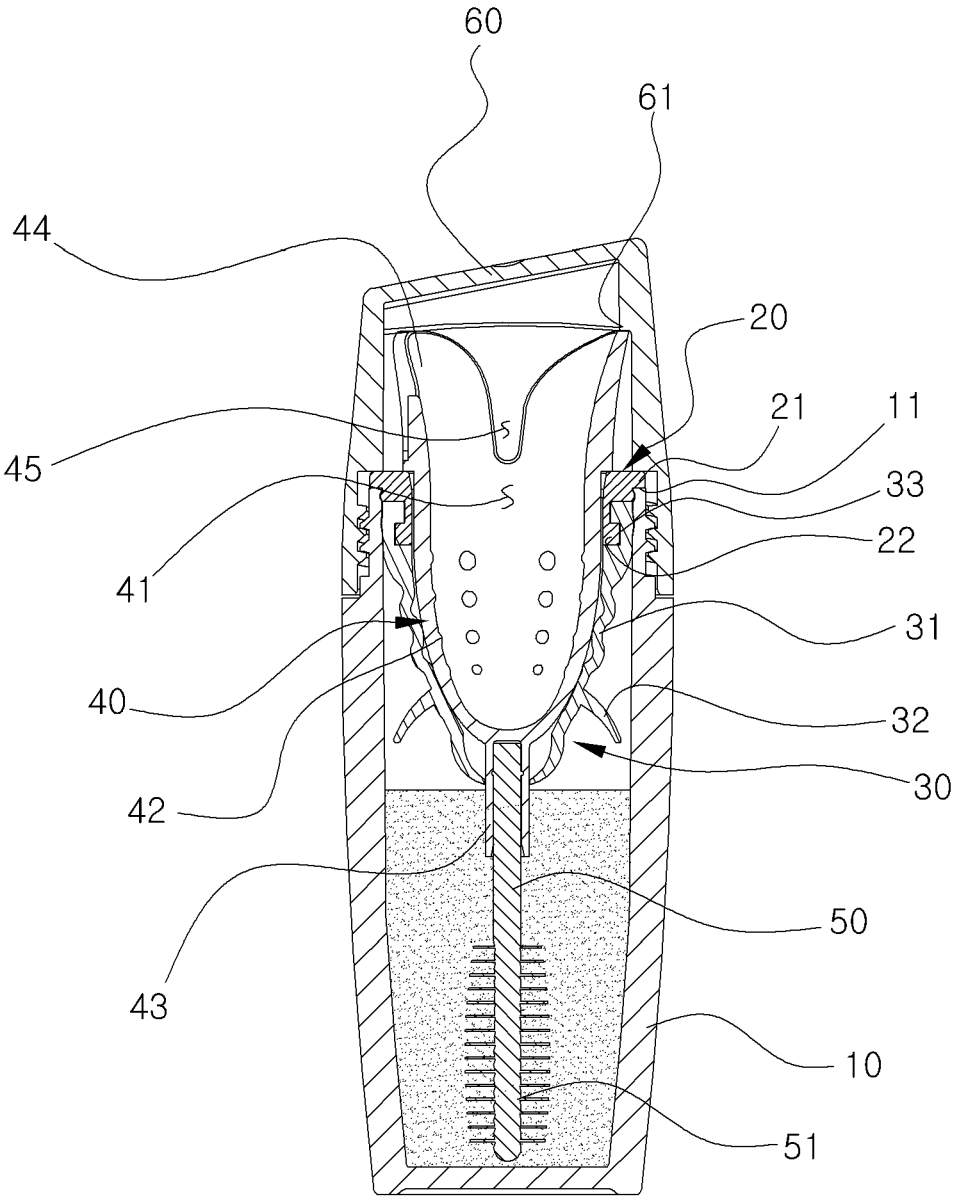
FIG. 6 is a sectional view showing the finger insertion mascara container including the wiper having the corrugated tube according to an embodiment of the present invention.
Figure 7:
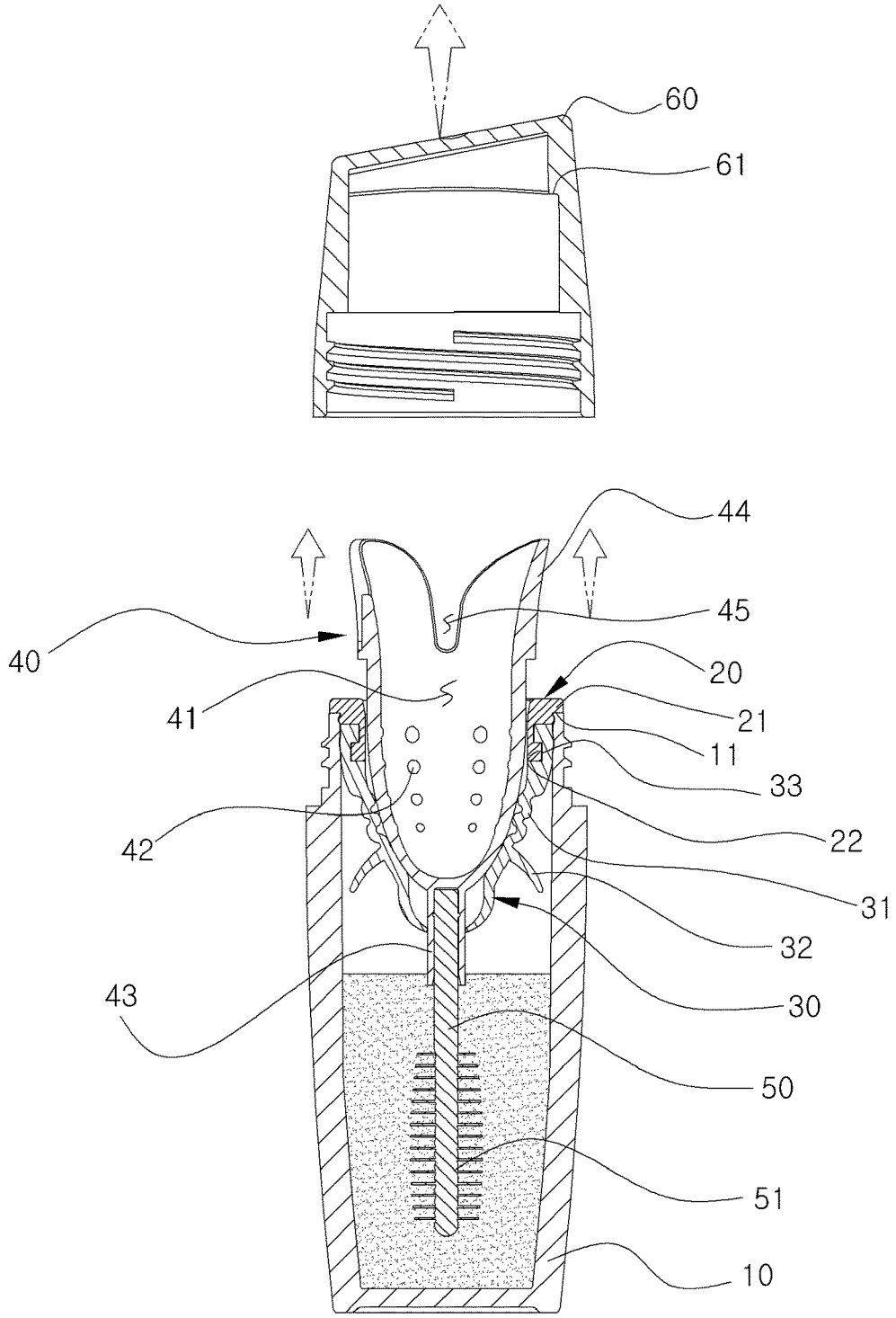
FIG. 7 is a sectional view showing a state in which a container lid of the finger insertion mascara container including the wiper having the corrugated tube according to an embodiment of the present invention is separated.
Figure 8:
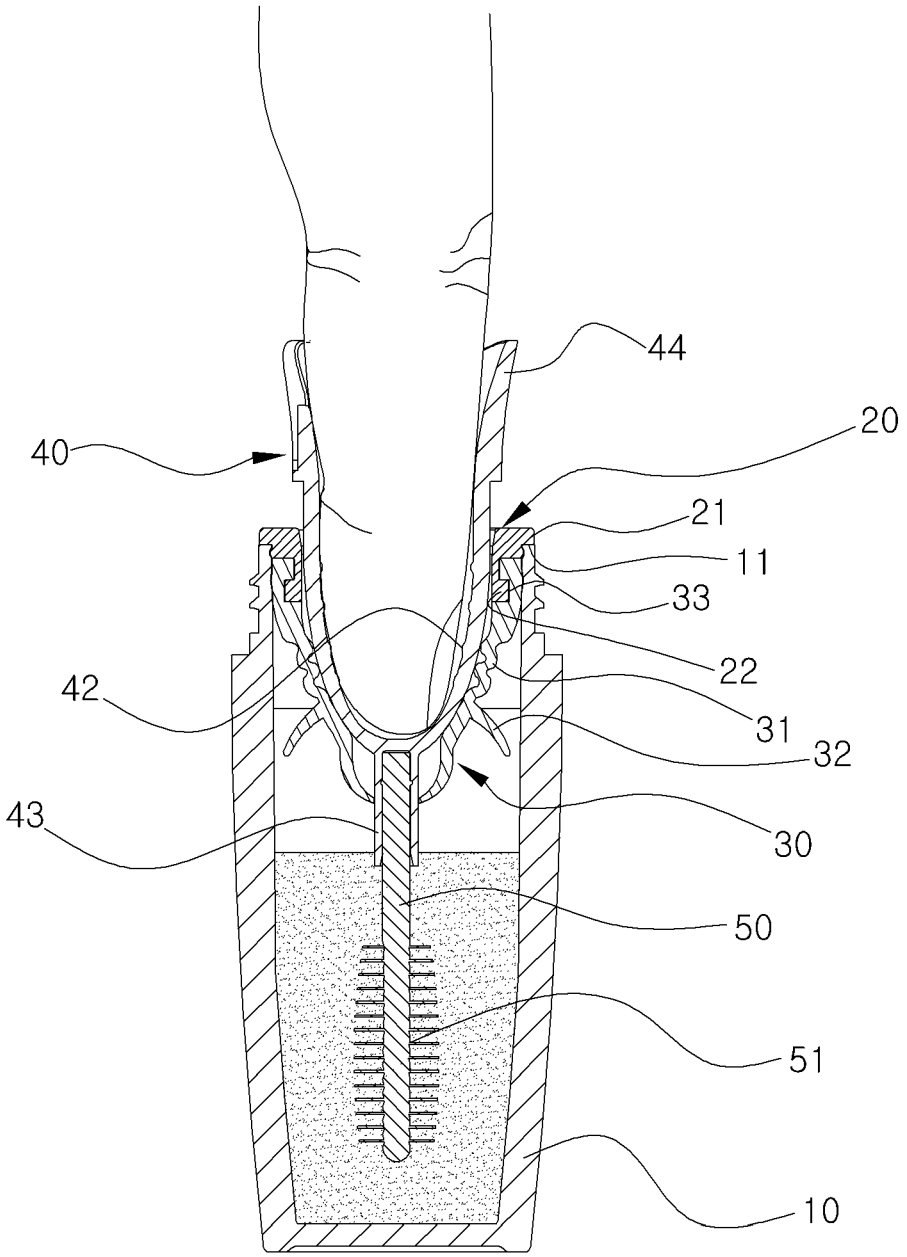
FIG. 8 is a sectional view showing a state in which a finger is inserted into a finger insertion member of the finger insertion mascara container including the wiper having the corrugated tube according to an embodiment of the present invention.
Figure 9:
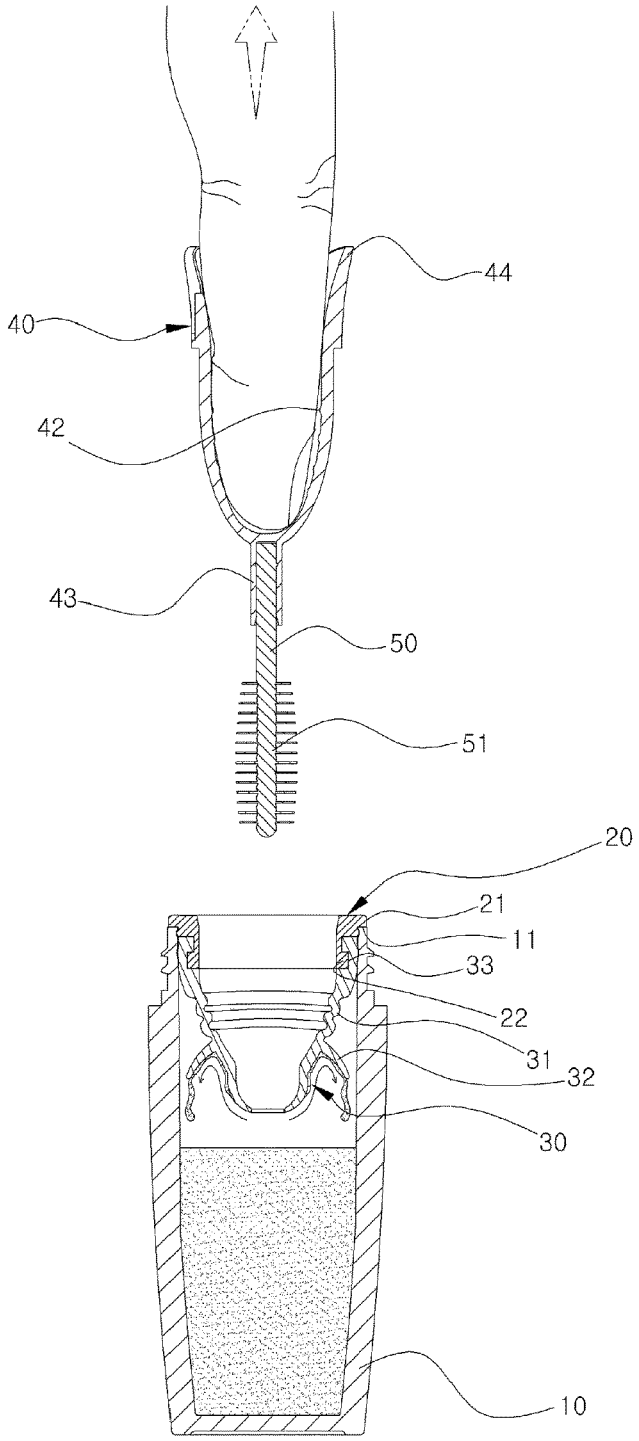
FIG. 9 is a sectional view showing a state in which the finger inserted into the finger insertion member of the finger insertion mascara container including the wiper having the corrugated tube according to an embodiment of the present invention is separated.
Figure 10:
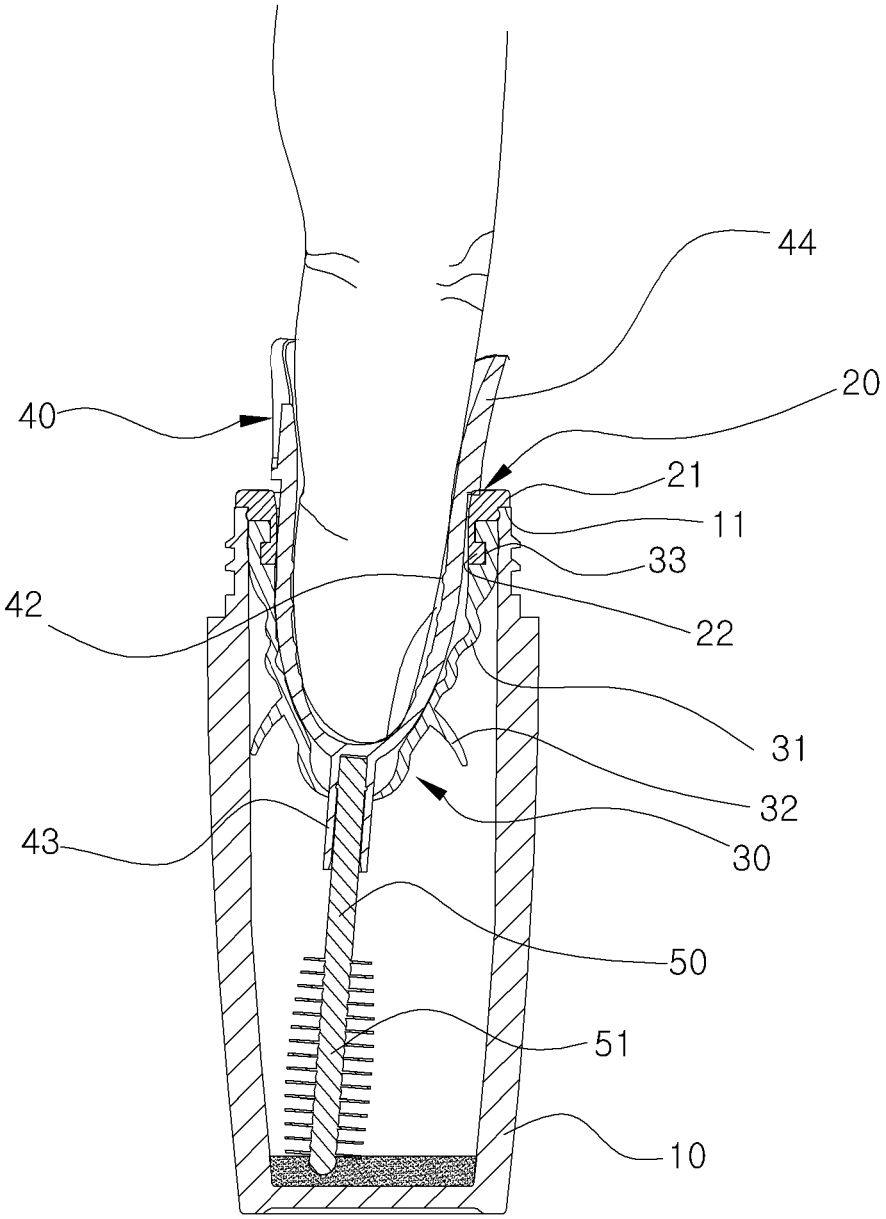
FIG. 10 is a sectional view showing a state in which the finger insertion member of the finger insertion mascara container including the wiper having the corrugated tube according to an embodiment of the present invention is pressed with the finger.
Figure 11:
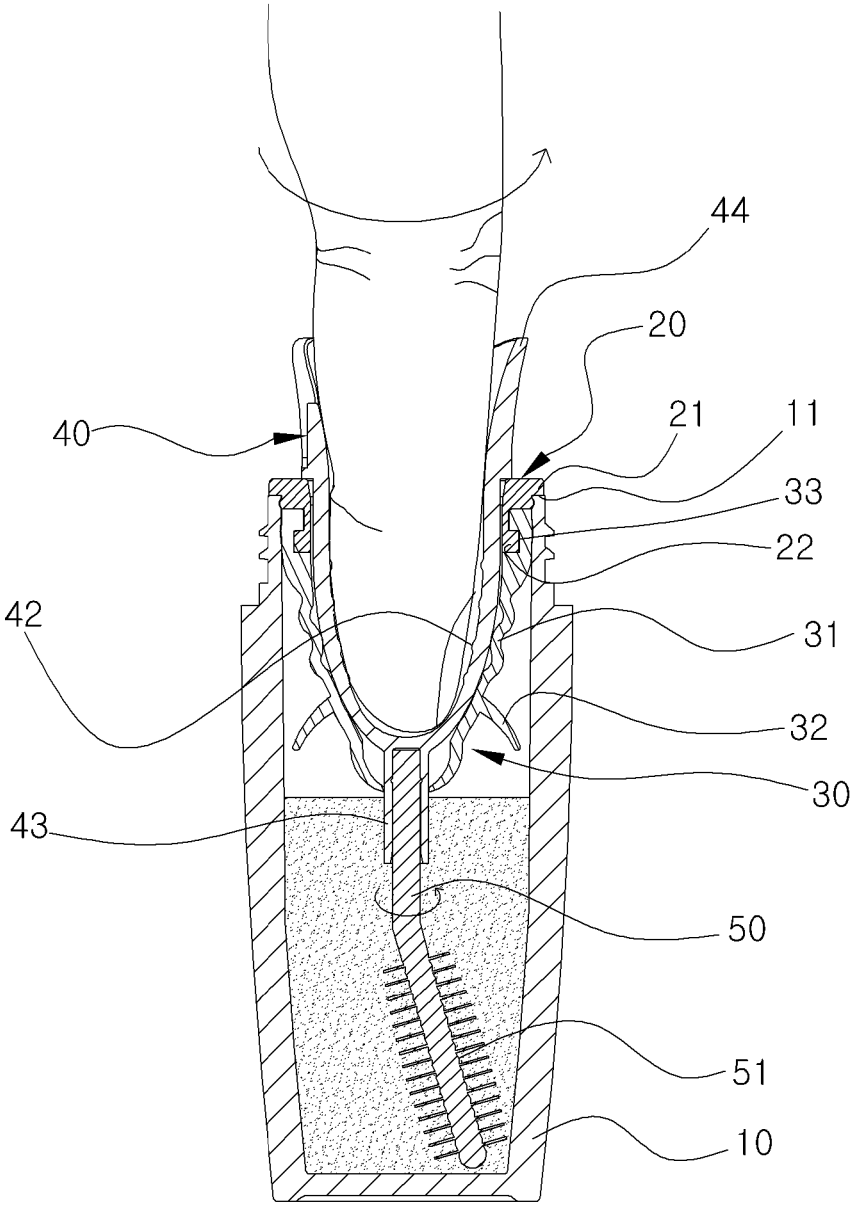
FIG. 11 is a sectional view showing a state in which the finger is inserted into the finger insertion member of the finger insertion mascara container including the wiper having the corrugated tube according to an embodiment of the present invention, and then rotated in the container body.

FIG. 4 is a perspective view showing a finger insertion mascara container including a wiper having a corrugated tube according to an embodiment of the present invention, and FIG. 5 is an exploded perspective view showing the finger insertion mascara container including the wiper having the corrugated tube according to an embodiment of the present invention. FIG. 6 is a sectional view showing the finger insertion mascara container including the wiper having the corrugated tube according to an embodiment of the present invention, and FIG. 7 is a sectional view showing a state in which a container lid of the finger insertion mascara container including the wiper having the corrugated tube according to an embodiment of the present invention is separated. FIG. 8 is a sectional view showing a state in which a finger is inserted into a finger insertion member of the finger insertion mascara container including the wiper having the corrugated tube according to an embodiment of the present invention, and FIG. 9 is a sectional view showing a state in which the finger inserted into the finger insertion member of the finger insertion mascara container including the wiper having the corrugated tube according to an embodiment of the present invention is separated. FIG. 10 is a sectional view showing a state in which the finger insertion member of the finger insertion mascara container including the wiper having the corrugated tube according to an embodiment of the present invention is pressed with the finger, and FIG. 11 is a sectional view showing a state in which the finger is inserted into the finger insertion member of the finger insertion mascara container including the wiper having the corrugated tube according to an embodiment of the present invention, and then rotated in the container body.

According to the present invention, a finger insertion mascara container including a wiper having a corrugated tube includes: a container body 10 containing a mascara liquid therein, and formed at an upper portion thereof with an opening 11; a wiper 30 installed in the opening 11 of the container body 10 to sweep the mascara liquid, and formed on an outer peripheral surface thereof with a corrugated tube 31; a finger insertion member 40 inserted into the wiper 30, formed therein with a finger insertion space 41, and formed at a lower side thereof with a coupling extension portion 43; and a brush rod 50 coupled to the coupling extension portion 43 of the finger insertion member 40, and formed at a lower side thereof with a brush 51.

The container body 10 contains the mascara liquid therein, and is formed at an upper end thereof with an opening 11.

The wiper 30 may be directly installed in the opening 11 of the container body 10, or may be coupled to the packing 20 and installed in the opening 11.

The packing 20 prevents the wiper 30 from being separated from the container body 10, and is preferably formed of a polypropylene (PP) or polyethylene (PE) material.

The packing 20 is formed at an upper end thereof with a latching sill 21, and formed on an outer peripheral surface thereof with a fastening protrusion wheel 22.

The latching sill 21 is latched to the opening 11 of the container body 10 to prevent the packing 20 from moving toward an inside of the container body 10.

The wiper 30 is coupled to the fastening protrusion wheel 22, and fitted between the fastening protrusion wheel 22 of the packing 20 and an inner wall of the container body 10.

The wiper 30 is coupled to the opening 11 of the container body 10 or the fastening protrusion wheel 22 of the packing 20, and serves to sweep the mascara liquid smeared on the brush rod 50.

The wiper 30 is formed of an elastic material so as to be elastically stretched and returned. Particularly, the wiper 30 is preferably formed of at least one material among natural rubber, elastomer, urethane rubber, nitrile-butadiene rubber (NBR), and silicone.

The wiper 30 is formed on the outer peripheral surface thereof with the corrugated tube 31, a counter-flow preventing protrusion wheel 32 is formed at a lower side of the corrugated tube 31, and the wiper 30 is formed in an upper inner peripheral surface thereof with a fastening annular groove 33.

The corrugated tube 31 is formed on the outer peripheral surface of the wiper 30. The corrugated tube 31 is elastically stretched to allow the brush 51 to smear the mascara liquid remaining in the lower portion of the container body 10 for use, thereby preventing the mascara liquid from remaining inside the container body 10.

In addition, the corrugated tube 31 extends downwards by the pressing of the finger insertion member 40 when the container lid 60 is coupled to the container body 10, so that the finger insertion member 40 may make close contact with an inside of the wiper 30, thereby preventing the mascara liquid contained in the container body 10 from being volatilized.

The counter-flow preventing protrusion wheel 32 is formed at a lower side of the corrugated tube 31.

As shown in FIG. 9, the counter-flow preventing protrusion wheel 32 may prevent the mascara liquid smeared on the brush rod 50 from rising on an outer peripheral surface of the wiper 30 when the finger insertion member 40 is separated from the container body 10. Accordingly, the counter-flow preventing protrusion wheel 32 serves to prevent the mascara liquid from entering and being solidified in a space between the wiper 30 and the inner wall of the container body 10.

The fastening protrusion wheel 22 of the packing 20 is coupled to the fastening annular groove 33 formed in the upper inner peripheral surface of the wiper 30 to prevent the wiper 30 from being separated from the inside of the container body 10.

The finger insertion member 40 is inserted into the wiper 30.

The finger insertion member 40 is formed therein with the finger insertion space 41, and formed at the lower side thereof with the coupling extension portion 43.

A finger is inserted into the finger insertion space 41, and the finger insertion space 41 is formed on an inner peripheral surface thereof with an anti-slip protrusion 42 to prevent the finger from slipping when the finger is inserted.

The brush rod 50 having the brush 51 is coupled to the coupling extension portion 43.

The brush rod 50 may be coupled to the coupling extension portion 43, or may be integrally formed with the finger insertion member 40.

In addition, as shown in FIG. 11, the brush rod 50 is formed to be bent, and the mascara liquid remaining in a lower edge of the container body 10 and the mascara liquid smeared on a wall surface may be smeared on the brush 51 for use by rotating the finger insertion member 40, thereby preventing the mascara liquid from remaining in the container body 10.

A finger retaining portion 44 extends from an upper portion of the finger insertion member 40, and the finger retaining portion 44 serves to retain the finger inserted into the finger insertion space 41.

An elastic slit portion 45 is formed in a middle of the finger retaining portion 44 to allow the finger insertion space 41 to be elastically widened and withdrawn, and the elastic slit portion 45 allows the finger to be inserted into the finger insertion space 41 regardless of the size of the finger.

A container lid 60 is coupled to the upper portion of the container body 10.

A pressing protrusion wheel 61 is formed at an inner upper portion of the container lid 60, and the pressing protrusion wheel 61 presses the finger retaining portion 44 of the finger insertion member 40 when the container lid 60 is closed as shown in FIG. 6.

The pressing protrusion wheel 61 presses an upper end of the finger retaining portion 44 while the wiper 30 is pushed to the lower portion of the container body 10 to allow the corrugated tube 31 to be stretched, so that the finger insertion member 40 may make close contact with the inside of the wiper 30 to tightly seal the container body 10, thereby preventing the mascara liquid contained in the container body 10 from being volatilized.

Hereinafter, a method of assembling the finger insertion mascara container including the wiper having the corrugated tube according to an embodiment of the present invention and the use of the same will be described in detail.

According to the present invention, the packing 20 is coupled to the opening 11 at the upper end of the container body 10. The fastening protrusion wheel 22 formed at the lower side of the packing 20 is fitted to the fastening annular groove 33 of the wiper 30, so that the wiper 30 is coupled to the lower side of the packing 20.

At this time, the wiper 30 is formed on the outer peripheral surface thereof with the corrugated tube 31, and the counter-flow preventing protrusion wheel 32 is formed at the lower side of the corrugated tube 31.

Thereafter, the wiper 30 is formed therein with the finger insertion space 41, the finger insertion member 40 formed at the lower side thereof with the coupling extension portion 43 is inserted, and the brush rod 50 having the brush 51 is coupled to the coupling extension portion 43.

In addition, the container lid 60 is coupled to the upper portion of the container body 10, the pressing protrusion wheel 61 is formed at the inner upper portion of the container lid 60, and the pressing protrusion wheel 61 presses the finger retaining portion 44 of the finger insertion member 40 when the container lid 60 is closed as shown in FIG. 6, which completes the assembly.

At this time, the wiper 30 is pushed to the lower portion of the container body 10 to allow the corrugated tube 31 to be stretched, so that the finger insertion member 40 may make close contact with the inside of the wiper 30 to tightly seal the container body 10, thereby preventing the mascara liquid contained in the container body 10 from being volatilized.

In order to use the mascara liquid of the finger insertion mascara container including the wiper having the corrugated tube, which is assembled by the above method, the container lid 60 is opened from the container body 10 as shown in FIG. 7. At this time, the corrugated tube 31 of the wiper 30, which is stretched by the pressing of the container lid 60, is shrunk, so that the finger insertion member 40 is moved upwards.

Thereafter, the finger is inserted into the finger insertion member 40 as shown in FIG. 8, and the finger insertion member 40 is separated from the container body 10 as shown in FIG. 9.

When the finger insertion member 40 is separated, the mascara liquid smeared on the brush rod 50 coupled to the finger insertion member 40 is swept by the wiper 30 and returns to the lower side due to the counter-flow preventing protrusion wheel 32 formed on the outer peripheral surface of the wiper 30, thereby preventing the mascara liquid from being solidified by entering the space between the wiper 30 and the inner wall of the container body 10.

Then, as shown in FIG. 10, when the mascara liquid remains in the lower portion of the container body 10, the finger insertion member 40 presses the wiper 30 downwards while the finger is inserted into the finger insertion space 41.

The corrugated tube 31 is elastically stretched when the wiper 30 is pressed, so that the brush 51 can smear the mascara liquid in the lower portion of the container body 10 for use, thereby preventing the mascara liquid from remaining inside the container body 10.

As described above, although the finger insertion mascara container including the wiper having the corrugated tube according to one embodiment of the present invention has been described for illustrative purposes, the present invention is not limited thereto. It is understood that various changes and modifications can be made by those skilled in the art without departing from the spirit and scope of the present invention as disclosed in the appended claims.

[Description of Reference numerals]

| | |
|---|---|
| 10: Container body | 11: Opening |
| 20: Packing | 21: Latching sill |
| 22: Fastening protrusion wheel | 30: Wiper |
| 31: Corrugated tube | |
| 32: Counter-flow preventing protrusion wheel | |
| 33: Fastening annular groove | |
| 40: Finger insertion member | 41: Finger insertion space |
| 42: Anti-slip protrusion | 43: Coupling extension portion |
| 44: Finger retaining portion | 45: Elastic slit portion |
| 50: Brush rod | 51: Brush |
| 60: Container lid | 61: Pressing protrusion wheel |

The invention claimed is:

1. A finger insertion mascara container including a wiper having a corrugated tube, the finger insertion mascara container comprising:

a container body (10) containing a mascara liquid therein, and formed at an upper portion thereof with an opening (11);

a wiper (30) installed in the opening (11) of the container body (10) to sweep the mascara liquid, and formed on an outer peripheral surface thereof with a corrugated tube (31);

a finger insertion member (40) inserted into the wiper (30), formed therein with a finger insertion space (41), and formed at a lower side thereof with a coupling extension portion (43); and a brush rod (50) coupled to the coupling extension portion (43) of the finger insertion member (40), and formed at a lower side thereof with a brush (51), wherein the wiper (30) having the corrugated tube (31) is formed of an elastic material so as to be elastically stretched and returned, and wherein a finger retaining portion (44) extends from an upper portion of the finger insertion member (40), and an elastic slit portion (45) is formed in a middle of the finger retaining portion (44).

2. The finger insertion mascara container of claim 1, further comprising a packing (20) coupled between the opening (11) of the container body (10) and the wiper (30).

3. The finger insertion mascara container of claim 1, further comprising a counter-flow preventing protrusion wheel (32) formed on a lower outer peripheral surface of the wiper (30) to prevent the mascara liquid from counter-flowing.

4. The finger insertion mascara container of claim 1, wherein the finger insertion member (40) is formed on an inner peripheral surface thereof with an anti-slip protrusion (42).

5. A finger insertion mascara container including a wiper having a corrugated tube, the finger insertion mascara container comprising:

a container body (10) containing a mascara liquid therein, and formed at an upper portion thereof with an opening (11);

a container lid (60) coupled to the upper portion of the container body (10);

a wiper (30) installed in the opening (11) of the container body (10) to sweep the mascara liquid, and formed on an outer peripheral surface thereof with a corrugated tube (31); and a finger insertion member (40) inserted into the wiper (30), formed therein with a finger insertion space (41), and formed at a lower side thereof with a brush rod (50), wherein a brush (51) is formed at an end of the brush rod (50), and the wiper (30) having the corrugated tube (31) is formed of an elastic material so as to be elastically stretched and returned.

6. The finger insertion mascara container of claim 5, wherein a pressing protrusion wheel (61) is formed on an inner surface of the container lid (60).

7. The finger insertion mascara container of claim 5, further comprising a packing (20) coupled between the opening (11) of the container body (10) and the wiper (30).

8. The finger insertion mascara container of claim 5, further comprising a counter-flow preventing protrusion wheel (32) formed on a lower outer peripheral surface of the wiper (30) to prevent the mascara liquid from counter-flowing.

9. The finger insertion mascara container of claim 5, wherein the finger insertion member (40) is formed on an inner peripheral surface thereof with an anti-slip protrusion (42).

* * * * *